US007549535B2

(12) United States Patent
Pelo

(10) Patent No.: US 7,549,535 B2
(45) Date of Patent: Jun. 23, 2009

(54) CARRYING SYSTEMS AND METHODS FOR DELICATE ITEMS

(75) Inventor: Rich Pelo, Bellingham, WA (US)

(73) Assignee: The Fairhaven Group, Inc., Bellingham, WA (US)

( * ) Notice: Subject to any disclaimer, the term of this patent is extended or adjusted under 35 U.S.C. 154(b) by 305 days.

(21) Appl. No.: 11/500,812

(22) Filed: Aug. 8, 2006

(65) Prior Publication Data

US 2007/0056865 A1 Mar. 15, 2007

Related U.S. Application Data

(60) Provisional application No. 60/708,304, filed on Aug. 9, 2005.

(51) Int. Cl.
*B65D 85/00* (2006.01)

(52) U.S. Cl. ..... 206/320; 206/583

(58) Field of Classification Search ..... 206/320, 206/583, 592, 576, 594
See application file for complete search history.

(56) References Cited

U.S. PATENT DOCUMENTS

| | | | | |
|---|---|---|---|---|
| 5,160,001 | A * | 11/1992 | Marceau | 190/102 |
| 5,217,119 | A | 6/1993 | Hollingsworth | |
| 5,494,157 | A * | 2/1996 | Golenz et al. | 206/320 |
| 5,524,754 | A * | 6/1996 | Hollingsworth | 206/320 |
| 5,725,090 | A * | 3/1998 | Vermillion et al. | 206/320 |
| 5,909,806 | A * | 6/1999 | Fischel et al. | 206/320 |
| 6,237,766 | B1 * | 5/2001 | Hollingsworth | 206/320 |
| 6,655,528 | B2 * | 12/2003 | King | 206/320 |
| 6,769,701 | B1 | 8/2004 | Clausen | |
| 2005/0000996 | A1 | 1/2005 | Petravic | |
| 2005/0258057 | A1 * | 11/2005 | Gelphman et al. | 206/320 |

FOREIGN PATENT DOCUMENTS

| | | | |
|---|---|---|---|
| WO | WO 00/27728 | A | 5/2000 |
| WO | WO 2006/136802 | A | 12/2006 |

OTHER PUBLICATIONS

Tumi, Website description of a computer sleeve product, www.tumi.com/products/index.cfm?fuseaction=image&ModelID=112929 &bb_id=cl..., Jun. 2004.

* cited by examiner

*Primary Examiner*—J. Gregory Pickett
*Assistant Examiner*—Jenine M Pagan
(74) *Attorney, Agent, or Firm*—Michael R. Schacht; Schacht Law Office, Inc.

(57) ABSTRACT

A system for a carrying an item comprises an inner sleeve assembly comprising first and second side panel assemblies and a perimeter panel assembly joined to define a sleeve chamber. The perimeter panel assembly comprises a first resilient member, a second resilient member, and a first elastic member. The first elastic member is arranged to apply a first bias force on the second resilient member to deform the second resilient member. The second resilient member applies a first sleeve chamber force on the first resilient member when the first elastic member deforms the second resilient member. When the item is inserted into the sleeve chamber, the first sleeve chamber force causes the first resilient member to engage the item, thereby holding the item in place within the sleeve chamber.

20 Claims, 10 Drawing Sheets

CARRYING SYSTEMS AND METHODS FOR DELICATE ITEMS

RELATED APPLICATIONS

This application claims priority of U.S. Provisional Patent Application Ser. No. 60/708,304 filed Aug. 9, 2005, the contents of which are incorporated herein by reference.

TECHNICAL FIELD

The present invention relates to systems and methods for carrying delicate items, such as computers, and, more specifically, to such carrying systems and methods that can easily be configured to accommodate items having different form factors.

BACKGROUND OF THE INVENTION

Specialized bags for carrying delicate items such as computers are well-known. Such bags typically employ one or more measures for protecting the delicate item from external shocks. Protective bags for delicate items are of two basic types: one type of protective bag for delicate items employs a rigid shell filled with foam to accommodate the form factor of the delicate item; a second type of protective bag uses a shell of flexible fabric lined with padding to absorb shocks. The present invention is of particular significance when applied to bags that use a flexible shell lined with padding.

The Applicant is also aware of systems that suspend an inner bag containing the delicate item within an outer bag. The suspension system protects the delicate item from vibrations and the like and also provides additional space around the delicate item for absorbing shocks.

While the flexible nature of the materials used to manufacture a flexible shell lined with fabric allow some tolerance for items of different sizes, the bags tend to be undersized for some items and oversized for other items. Use of a bag that is too small or too large for the delicate item being carried can compromise the protection provided by the bag. Accordingly, bags are often custom made for delicate items having a particular form factor. The need to manufacture, distribute, and stock bags of different sizes for different form factors of delicate items can be expensive and wasteful.

The need thus exists for protective bags that can accommodate delicate items of different form factors without compromising on protection of the delicate item.

SUMMARY OF THE INVENTION

The present invention may be embodied as a system for a carrying an item comprising an inner sleeve assembly comprising first and second side panel assemblies and a perimeter panel assembly joined to define a sleeve chamber. The perimeter panel assembly comprises a first resilient member, a second resilient member, and a first elastic member. The first elastic member is arranged to apply a first bias force on the second resilient member to deform the second resilient member. The second resilient member applies a first sleeve chamber force on the first resilient member when the first elastic member deforms the second resilient member. When the item is inserted into the sleeve chamber, the first sleeve chamber force causes the first resilient member to engage the item, thereby holding the item in place within the sleeve chamber.

DETAILED DESCRIPTION OF THE INVENTION

Figure 1:
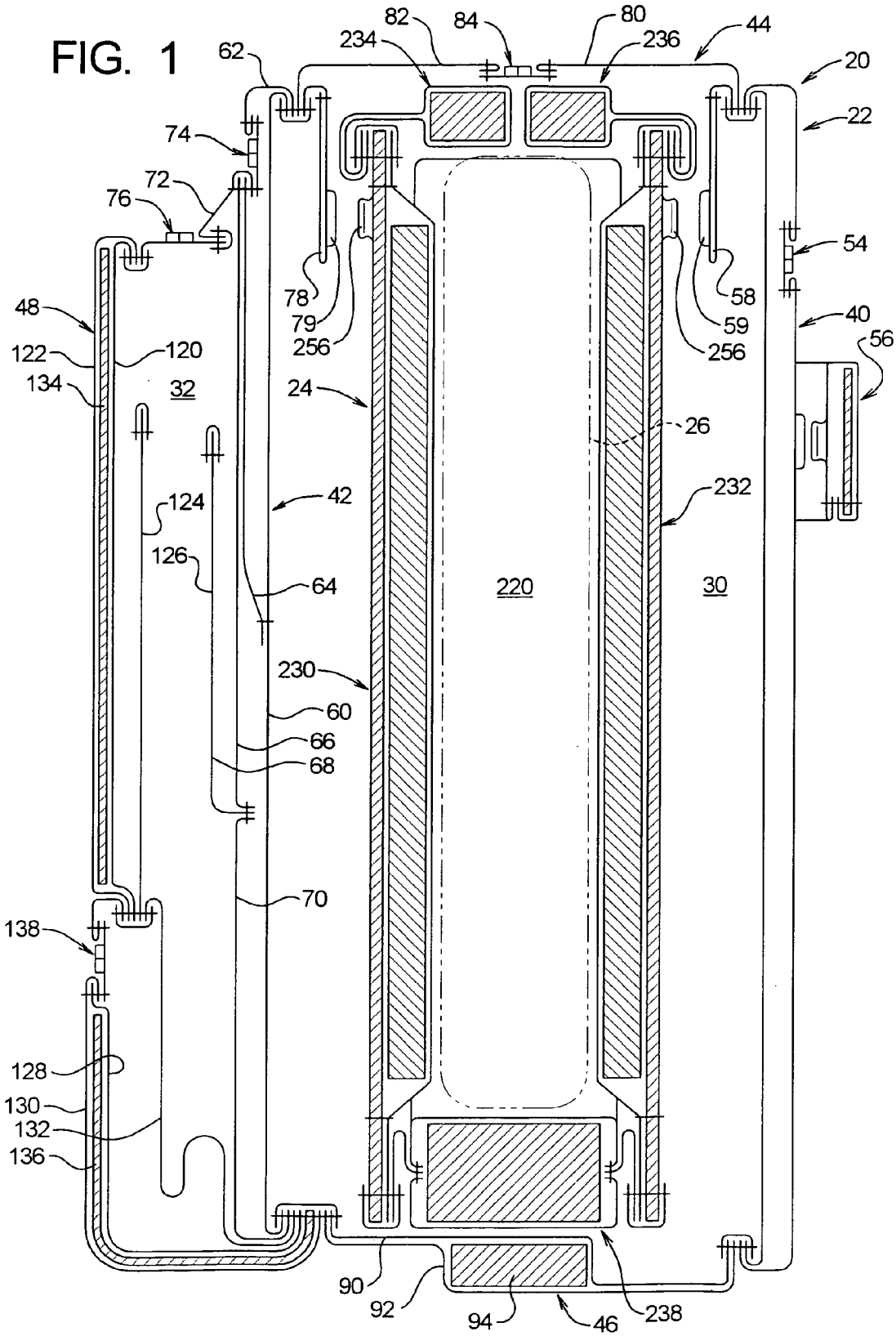
FIG. 1 is a schematic, side elevation, cut-away view of a carrying system of a first embodiment of the present invention.
Figure 2:
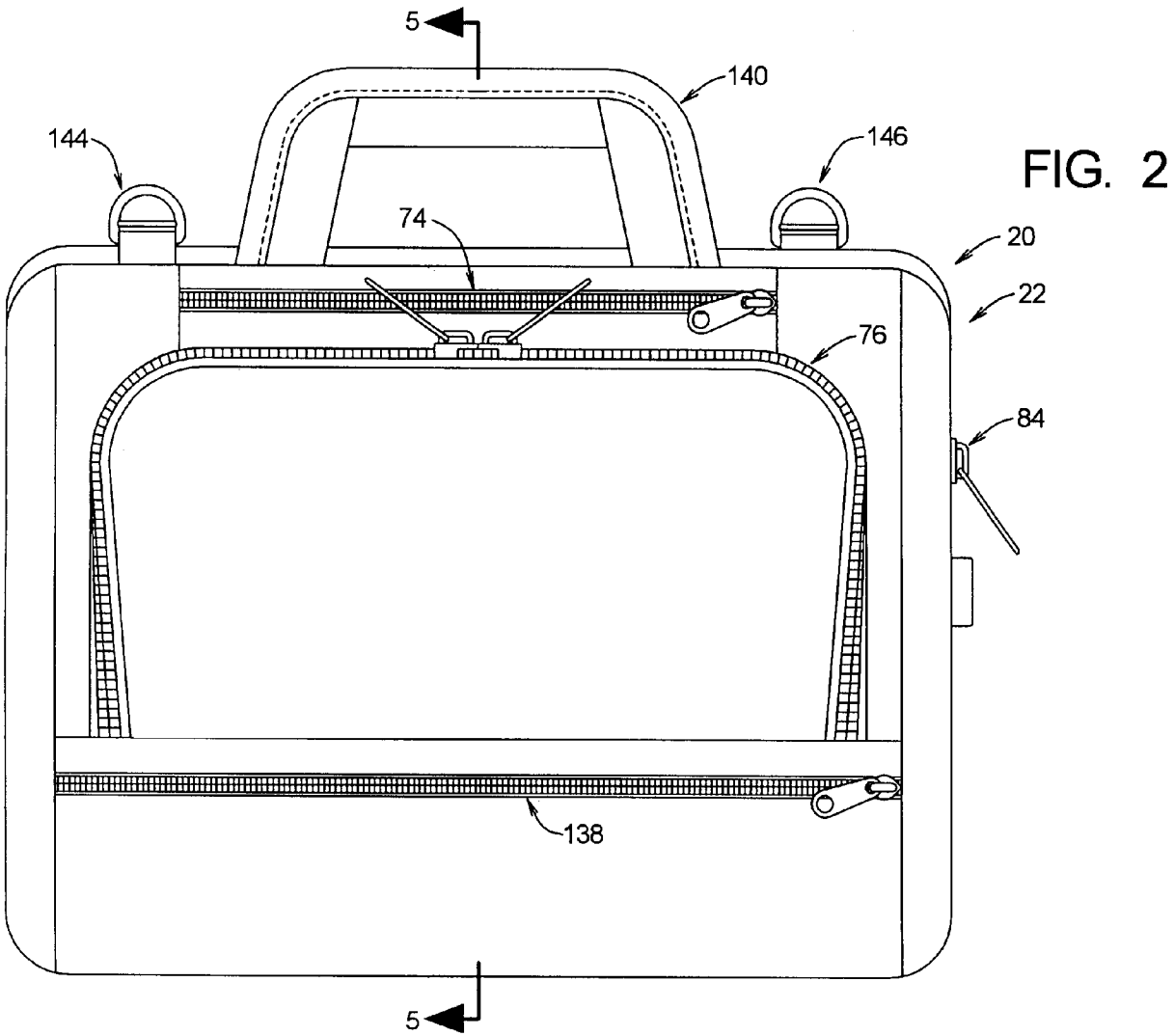
FIG. 2 is a front elevation view of a carrying system of a FIG. 1.
Figure 3:
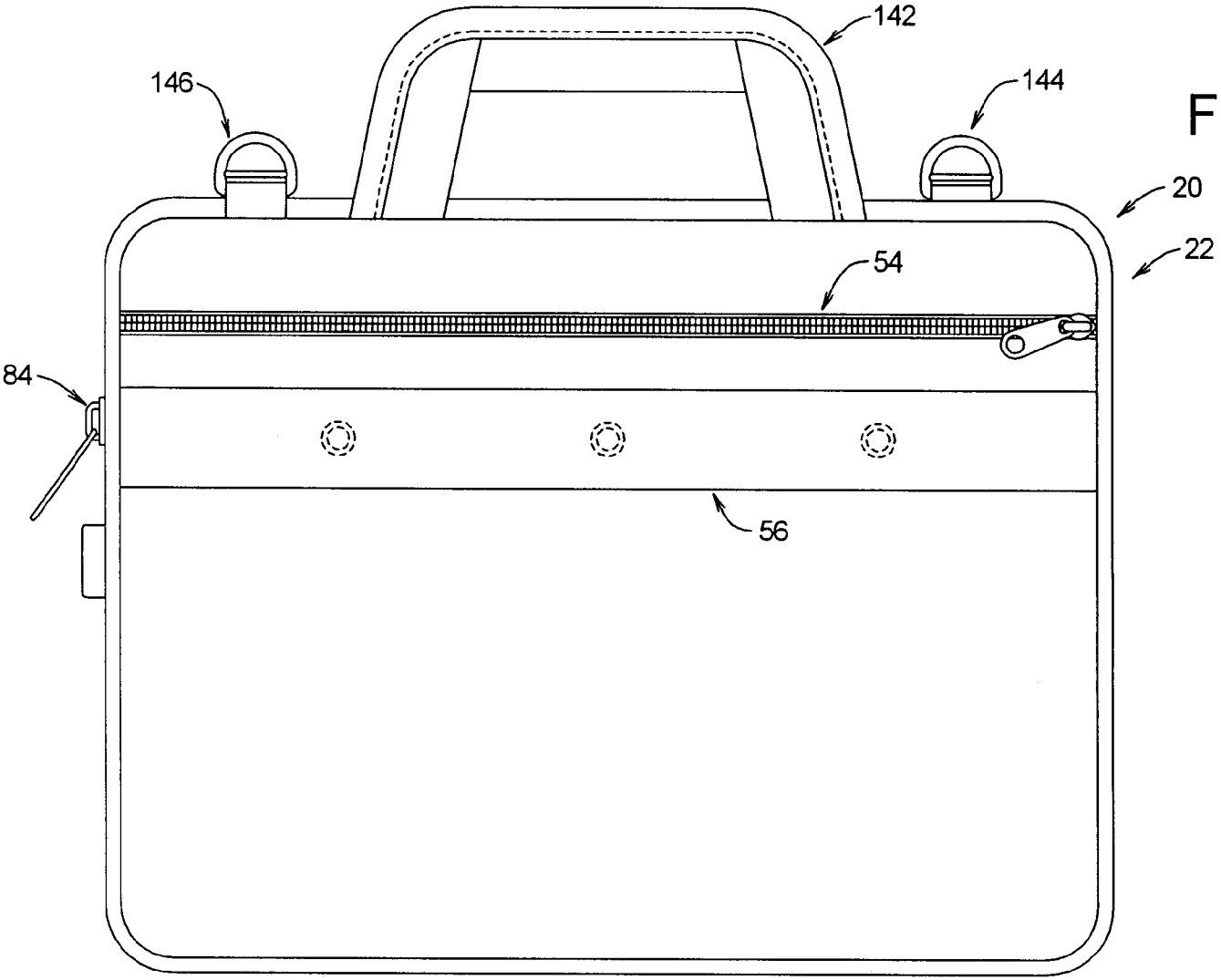
FIG. 3 is a rear elevation view of the carrying system of FIG. 1.

Referring initially to FIG. 1 of the drawing, depicted at 20 therein is a carrying system constructed in accordance with, and embodying, the principles of the present invention. The carrying system 20 comprises an outer bag assembly 22 and an inner sleeve assembly 24. The carrying system 20 allows a user to carry a delicate item 26 such as a computer. Although the carrying system 20 is capable of carrying items such as clothing that are not delicate, the carrying system 20 may not be a cost effective method of transporting such non-delicate items.

Figure 6:
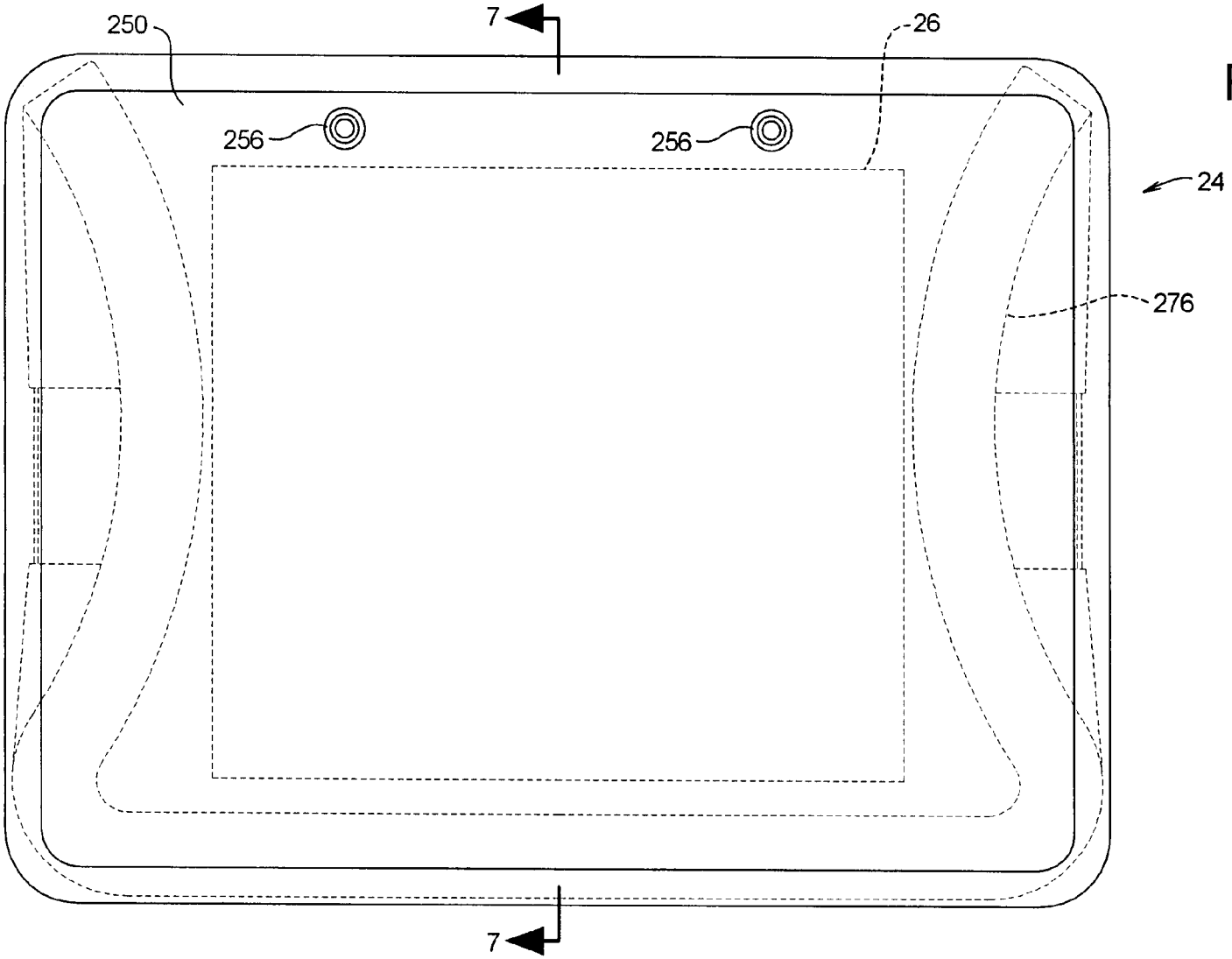
FIG. 6 is a front elevation view of a sleeve assembly of the carrying system of FIG. 1.
Figure 7:
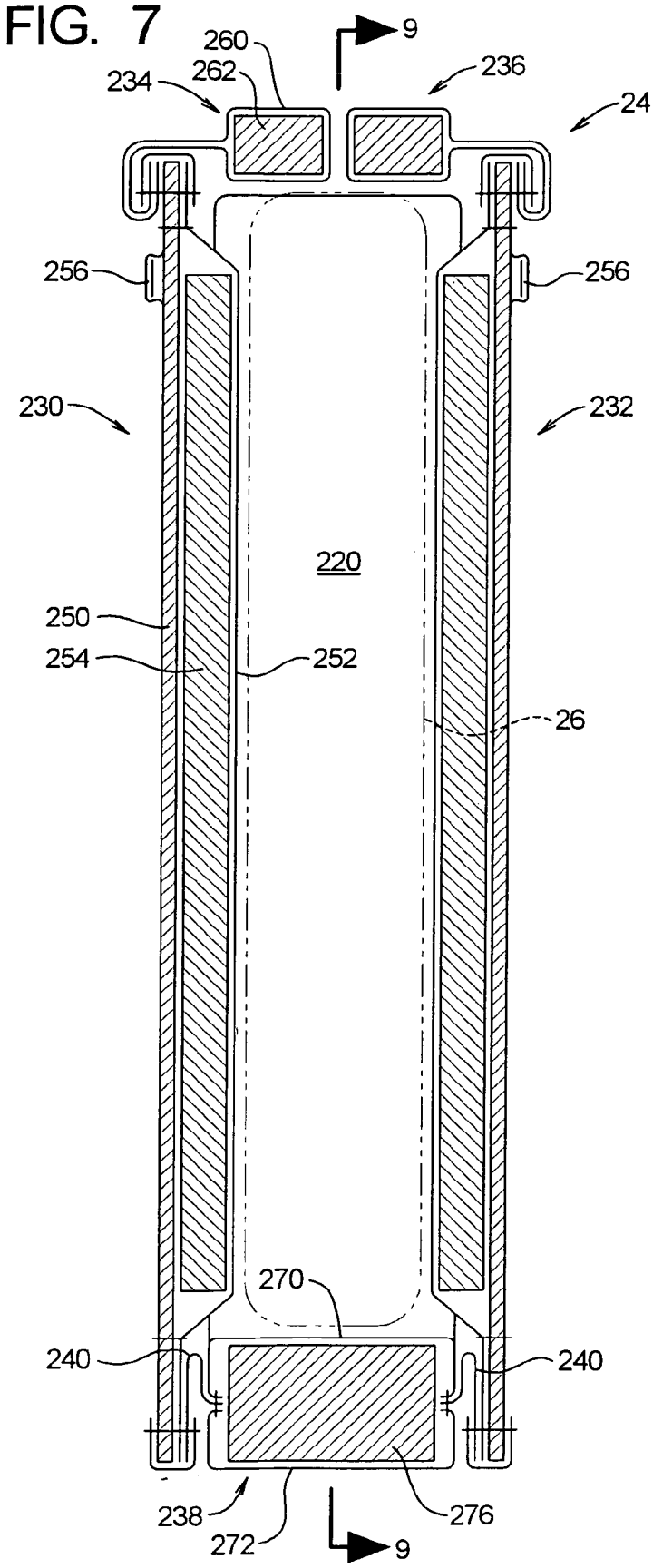
FIG. 7 is a schematic, side elevation, cut-away view of sleeve assembly of FIG. 6 in a first configuration.

The example outer bag assembly 22 is adapted to contain the inner sleeve assembly 24. FIG. 6 illustrates that the inner sleeve assembly 24 is adapted to contain the delicate item 26. In use, a user inserts the item 26 into the sleeve assembly 24 and the sleeve assembly 24 into the bag assembly 22. The user then grasps the bag assembly 22 to carry the delicate item 26.

Figure 4:
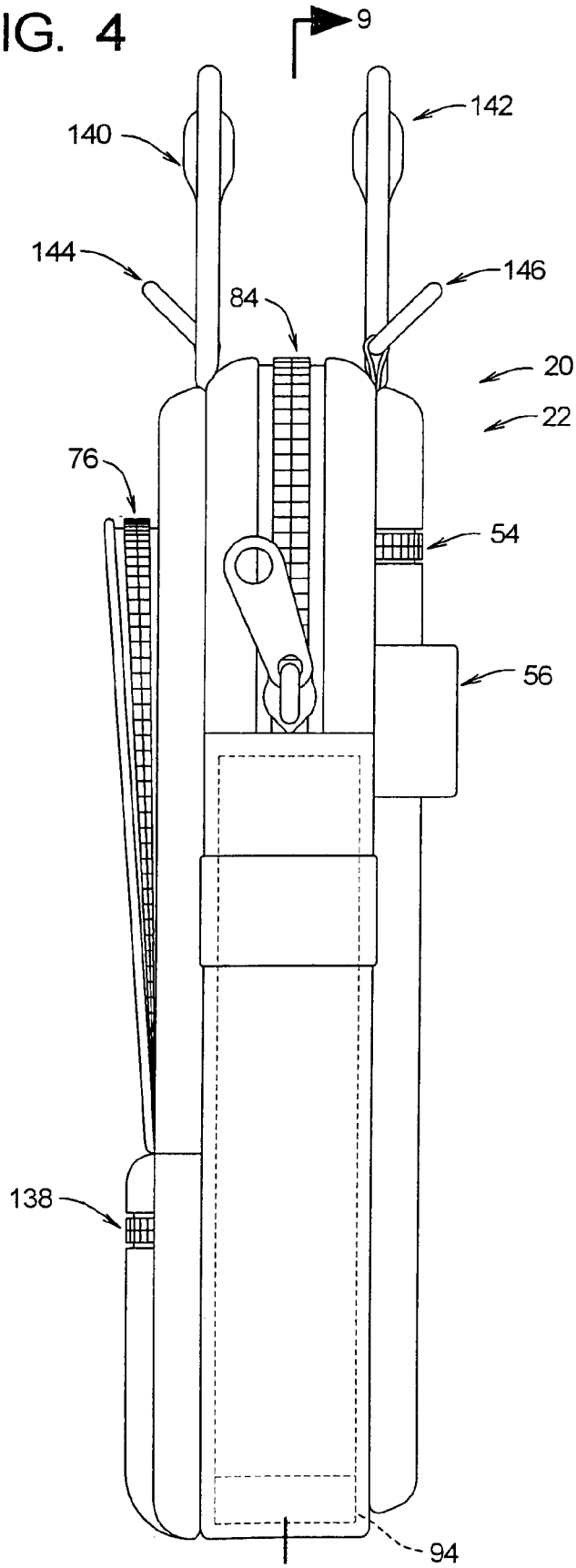
FIG. 4 is a side elevation view of the carrying system of FIG. 1.
Figure 5:
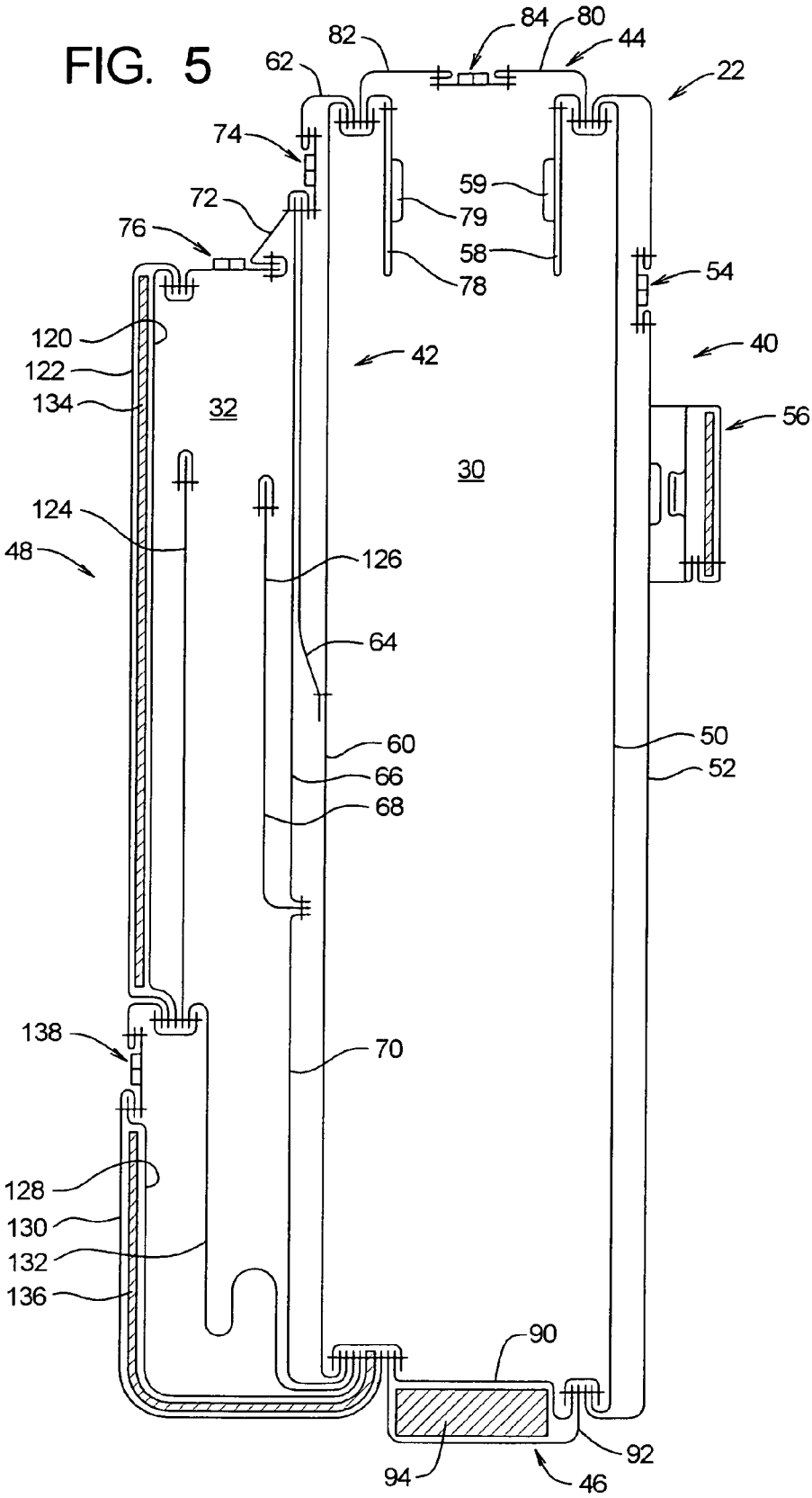
FIG. 5 is a schematic, side elevation, cut-away view of a bag assembly of the carrying system of FIG. 1.

Referring to FIGS. 2-5, the construction and use of the example outer bag assembly 22 will now be described. The example bag assembly 22 takes the form of a briefcase or small suitcase defining, as shown in FIG. 5, a primary chamber 30, a secondary chamber 32, and a rear chamber 34. Still referring to FIG. 5, it can be seen that the bag assembly 22 comprises a rear panel assembly 40, a primary panel assembly 42, an upper panel assembly 44, an edge panel assembly 46, and a secondary panel assembly 48.

The rear panel assembly 40 and primary panel assembly 42 are connected to the upper panel assembly 44 and the edge panel assembly 46 to define the primary chamber 30. FIG. 4 illustrates that the edge panel assembly 46 extends along the bottom and a portion of the sides of the bag assembly 22. The upper panel assembly 44 similarly extends along the top and a portion of the sides of the bag assembly 22. The secondary panel assembly 48 is connected to the primary panel assembly 42 to define the secondary chamber 32.

The rear panel assembly 40 comprises first and second rear panels 50 and 52, a rear zipper assembly 54, a strap assembly 56, and a snap panel 58. The first and second rear panels 50 and 52 are connected along their peripheral edges to define the rear chamber 34. A female snap fastener portion 59 is supported by the snap panel 58.

The primary front panel assembly 42 comprises first through seventh primary panels 60, 62, 64, 66, 68, 70, and 72, first and second primary zipper assemblies 74 and 76, and a snap panel 78. A female snap fastener portion 79 is supported by the snap panel 78.

The upper panel assembly 44 comprises first and second upper panels 80 and 82 and an upper zipper assembly 84. The edge panel assembly 46 comprises first and second edge panels 90 and 92 and a resilient member 94. The secondary panel assembly 48 comprises first through seventh panels 120, 122, 124, 126, 128, 130, and 132, first and second resilient members 134 and 136, and a secondary zipper assembly 138.

The various panels 50, 52, 60-72, 80, 82, 90, 92, and 120-132 are sheets of fabric that are sewn together and to the zipper assemblies 54, 74, 76, 84, and 138 to define a number of pockets within the chambers 30 and 32. The zipper assemblies allow access by the user to certain of these pockets, while the pockets formed by the panels 90 and 92, by the panels 120 and 122, and by the panels 128 and 130 are enclosed and contain the resilient members 94, 134, and 136, respectively. The resilient members 94, 134, and 136 are typically foam sheets that provide both some stiffness to the bag assembly 22 and also shock protection for the contents of the chambers 30 and 32.

The fabric forming the panels of the example bag assembly 22 are waterproof or water resistant. Accordingly, the construction of the example bag assembly 22 is such that rain, for example, is substantially prevented from entering the primary, secondary, and rear chambers 30, 32, and 34 under typical use conditions.

The example bag assembly 22 further comprises first and second handle assemblies 140 and 142 and first and second strap loop assemblies 144 and 146. The handle assemblies 140 and 142 are symmetrically connected to the front and back of the upper zipper assembly 84 to facilitate carrying of the bag assembly 22 by hand. The first and second strap loop assemblies 144 and 146 are also connected on either side of the zipper assembly 84 but on opposite sides of the handle assemblies 140 and 142. The strap loop assemblies 144 and 146 allow a strap (not shown) to be used to hang the bag assembly 22 from a user's shoulder.

Although the example bag assembly 22 is optimized for use as part of the carrying system 20 of the present invention, bag assemblies of other configurations may be used, instead of the example bag assembly 22, as part of the carrying system 20.

Referring now to FIGS. 6-10 the example inner sleeve assembly 24 will be described in further detail. As perhaps best shown in FIGS. 7 and 8, the inner sleeve assembly 24 defines a sleeve chamber 220 in which the delicate item 26 is contained. Still referring to FIGS. 7 and 8, it can be seen that the sleeve assembly 24 comprises first and second side panel assemblies 230 and 232, first and second opening panel assemblies 234 and 236, and a perimeter panel assembly 238.

Figure 8:
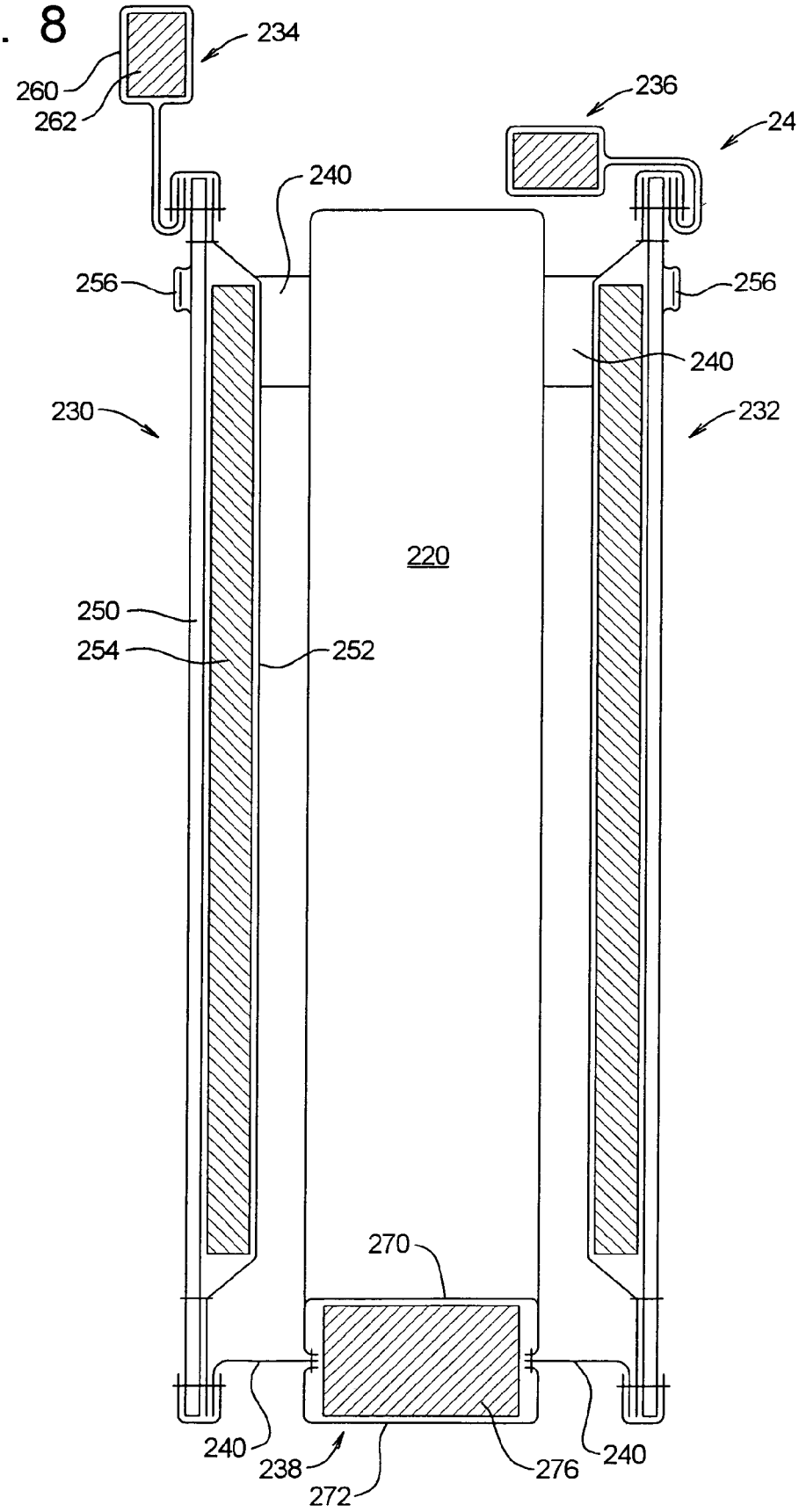
FIG. 8 is a schematic, side elevation, cut-away view of sleeve assembly of FIG. 6 in a second configuration.

The first and second side panels 230 and 232 define front and rear portions of the sleeve chamber 220. The first and second side panel assemblies 230 and 232 are joined to the perimeter panel assembly 238 by connecting strap members 240 such that the perimeter panel assembly 238 extends along the lateral and lower edges of the sleeve chamber 220. The first and second opening panel assemblies 234 and 236 are connected to the first and second side panel assemblies 230 and 232, respectively, so that the opening panel assemblies 234 and 236 extend along an upper edge of the sleeve chamber 220. The opening panel assemblies 234 and 236 may be configured in open and closed configurations as shown in FIG. 8.

The connecting strap members 240 may extend along the entire connection between each of the side panel assemblies 230 and 232 and the perimeter panel assembly 238. In the example sleeve assembly 24, the connecting strap members 240 take the form of three discrete sheets of material connecting perimeter panel assembly 238 to each of the side panel assemblies 230 and 232.

The example first and second side panel assemblies 230 and 232 are constructed in the same manner, and only the first side panel assembly 230 will be described in detail herein. The first side panel assembly 230 comprises a semi-rigid outer panel 250, a fabric inner panel 252, a resilient member 254, and male snap fastener portions 256. The outer panel 250 and inner panel 252 are joined together to define an enclosed pocket that contains the resilient member 254. The snap fasteners are secured to the outer panel 250. The outer panel 250 provides puncture resistance and stiffness, while the resilient member 254 is a foam sheet that provides shock absorption.

The example first and second opening panel assemblies 234 and 236 are also identical, and only the first opening panel assembly 234 will be described in detail herein. The first opening panel assembly 234 comprises a fabric panel 260 and a resilient member 262. The panel 260 is arranged to define an enclosed pocket that contains the resilient member 262.

Figure 9:
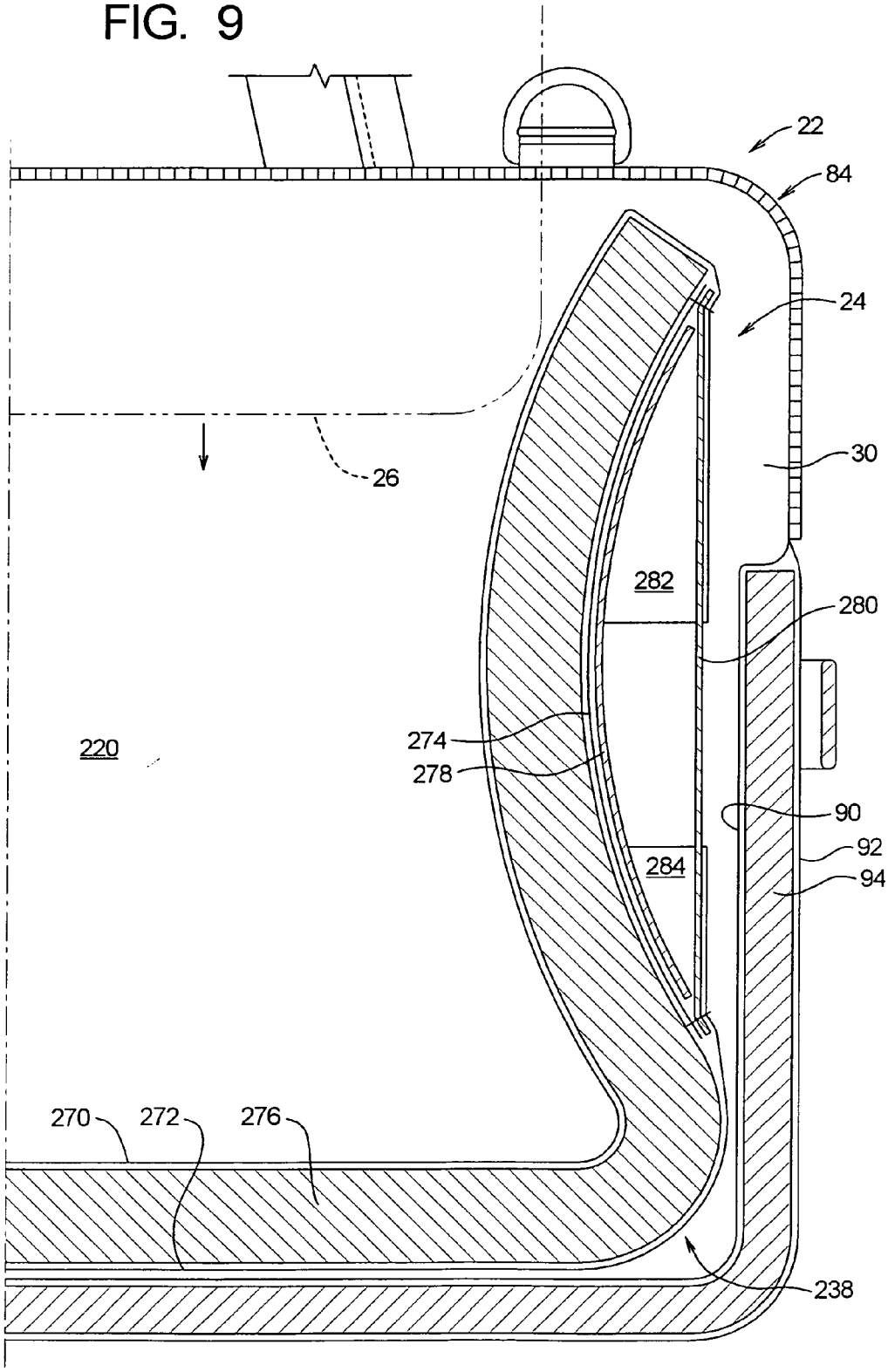
FIG. 9 is a schematic, partial front elevation, cut-away view taken along lines 9-9 in FIG. 7 of the sleeve assembly prior to insertion of an example delicate item.
Figure 10:
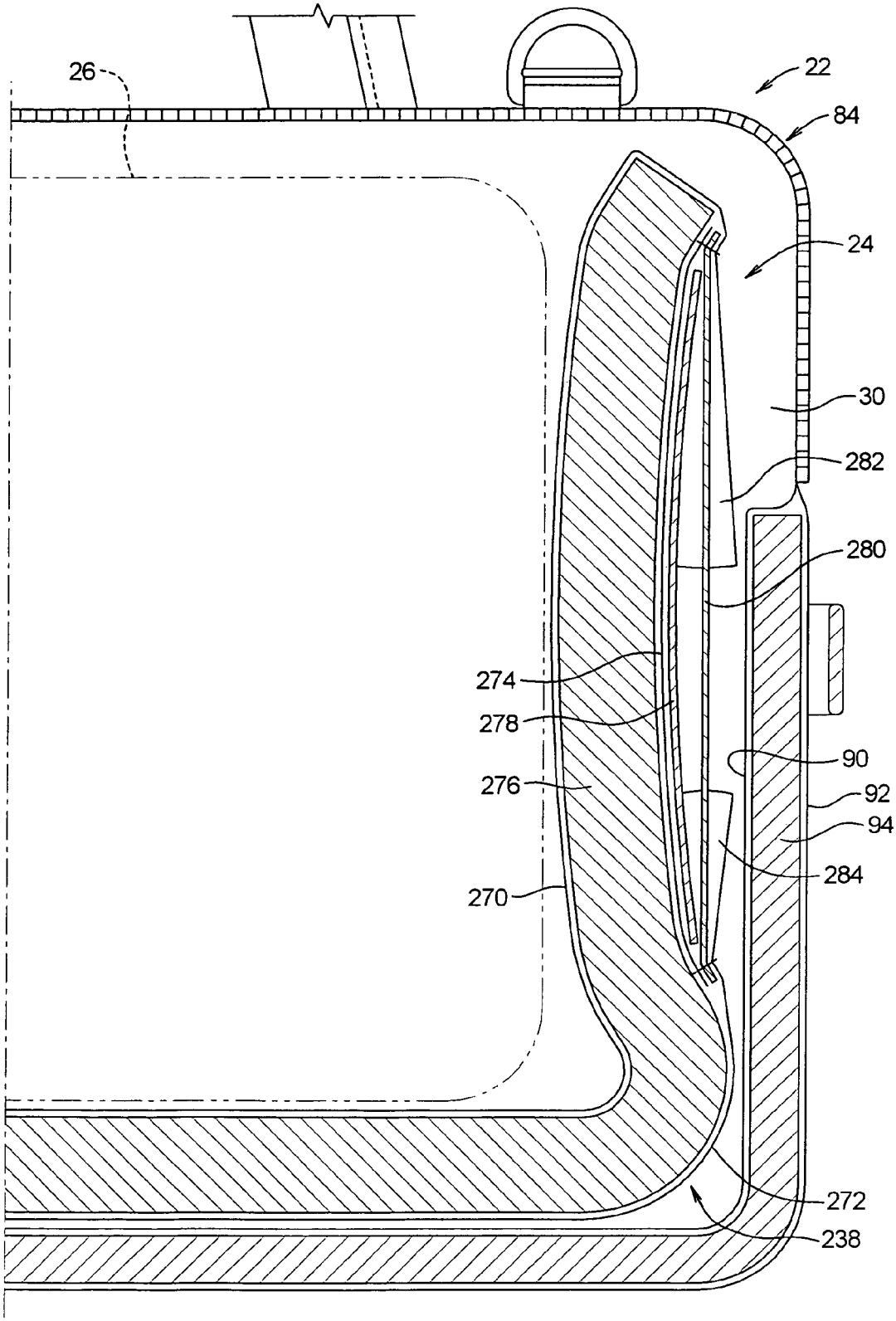
FIG. 10 is a schematic, partial front elevation, cut-away view taken along lines 9-9 in FIG. 7 of the sleeve assembly after insertion of the example delicate item.

Referring now to FIGS. 9 and 10, it can be seen that the perimeter panel assembly 238 comprises an inner fabric panel 270, first and second outer fabric panels 272 and 274, a first resilient member 276, a second resilient member 278, and an elastic member 280. The inner panel 270 and the outer panels 272 and 274 are joined together to form an enclosed pocket that contains the first resilient member 276. Portions of the inner panel 270 and the outer panel 272 overlap the second outer panel 274 to define first and second retaining pockets 282 and 284. The elastic member 280 is connected to the inner panel 270 and the outer panel 272 between the retaining pockets 282 and 284.

The second resilient member 278 is a normally flat, semi-rigid plastic sheet the ends of which are inserted into the retaining pockets 282 and 284. The elastic member 280 exerts a bias force on the retaining pockets 282 and 284 that causes the second resilient member 278 to bow as shown in FIG. 9 when no external forces are applied to the second resilient member 278.

When an external force is applied to the second resilient member 278, such as by the item 26 through the first resilient member 276 as shown in FIG. 10, the elastic member 280 tends to straighten and apply tension to the elastic member 280. This tension of the elastic member 280 tends to force the second resilient member 278 against the first resilient member 276 and thus the first resilient member 276 against the item 26. The force applied by the second resilient member 278 against the first resilient member 276 will be referred to herein as a sleeve chamber force. The combination of sleeve chamber forces applied by the resilient members 276 and 278 and the elastic member 280 on each side of the item 26 securely hold the item 26 in place within the sleeve chamber 220.

FIGS. 1, 9, and 10 show that the sleeve assembly 24 is supported within the bag assembly 22. In particular, the male snap fastener portions 256 supported by the sleeve assembly 24 engage the female snap portions 59 and 79 supported by the bag assembly 22. The sleeve assembly 24 is thus supported at a desired location within the primary chamber 30.

When the item 26 is located within the sleeve chamber 220 and the sleeve assembly 24 is located within the primary chamber 30, the item 26 is protected along all edges and sides by at least one layer of resilient material. The bottom edge of the item 26 is protected by two layers of resilient material, and the front and back sides thereof are protected by a layer of resilient material, a dead air space, and a layer of semi-ridge material. The side edges of the item 26 are protected by a layer of resilient material and the interaction of the resilient member 278 and the elastic member 280.

The carrying system 20 thus provides along the upper (least vulnerable) edge one protective layer and along the front, back, bottom, and lateral side edges of the item 26 two protective layers or systems.

In addition, the carrying system 20 snugly supports items 26 having different form factors. As shown by a comparison of FIGS. 7 and 8, the front to back dimensions of the sleeve chamber 220 can change to accommodate different thicknesses of items 26. The spring or clamp action depicted in FIGS. 9 and 10 further accommodates items having different lateral dimensions between vertical side edges thereof when supported by the system 20. The carrying system 20 thus snugly accommodates a wide range of form factors of the items 26.

What is claimed is:

1. A system for a carrying an item, comprising:

an inner sleeve assembly comprising first and second side panel assemblies and a perimeter panel assembly joined to define a sleeve chamber; wherein the perimeter panel assembly comprises a deformable resilient member, a semi rigid resilient member, and an elastic member;

the elastic member applies bias force on the semi-rigid resilient member to deform the semi-rigid resilient member;

when deformed by the elastic member, the semi-rigid resilient member applies a sleeve chamber force on the first resilient member to deform the deformable resilient member; and when the item is inserted into the sleeve chamber, the item deforms the deformable resilient member, the deformable resilient member deforms the semi-rigid resilient member, and the semi-rigid resilient member deforms the elastic member such that the item is snugly held in place within the sleeve chamber.

2. A system as recited in claim 1, further comprising an outer bag assembly defining a primary chamber, where the inner sleeve assembly is disposed within the primary chamber.

3. A system as recited in claim 2, in which:

the outer bag assembly comprises a first connector portion; and the inner sleeve assembly comprises a second connector portion; wherein the first connector portion engages the second connector portion to support the inner sleeve assembly within the primary chamber.

4. A system as recited in claim 1, in which, when the item is inserted into the sleeve chamber, the item displaces the first resilient member against the sleeve chamber force and the first resilient member displaces the second resilient member against the bias force to allow a first dimension of the sleeve chamber to be altered.

5. A system as recited in claim 1, further comprising at least one connecting strap member, wherein:

the at least one connecting strap member joins the first side panel and the second side panel to the perimeter panel; and the connecting strap members are deformable to allow a second dimension of the sleeve chamber to be changed.

6. A system as recited in claim 1, in which the inner sleeve assembly further comprises first and second pockets, wherein:

the elastic member is connected to the first and second pockets;

the semi-rigid resilient member defines first and second ends that are received by the first and second pockets, respectively; and when the first and second ends of the semi-rigid resilient member are received by the first and second pockets, the elastic member is stretched and the semi-rigid member is deformed.

7. A system as recited in claim 1, in which:

the semi-rigid resilient member comprises an elongate member that bends when subjected to the bias force; and when the elongate member bends, the elongate member deforms to apply the sleeve chamber force on the deformable resilient member.

8. A system as recited in claim 1, in which the:

the semi-rigid resilient member comprises an elongate member; and when the bias force is applied to the elongate member, the elongate member bows such that a middle portion of the elongate member moves towards the sleeve chamber.

9. A system as recited in claim 1, in which the perimeter panel assembly comprises:

first and second semi-rigid resilient members, and first and second elastic members; wherein the first elastic member is arranged to apply a first bias force on the first semi-rigid resilient member to deform the first semi-rigid resilient member;

the second elastic member is arranged to apply a second bias force on the second semi-rigid resilient member to deform the second semi-rigid resilient member;

the first semi-rigid resilient member applies a first sleeve chamber force on the deformable resilient member when the first elastic member deforms the first semi-rigid resilient member;

the second semi-rigid resilient member applies a second sleeve chamber force on the deformable resilient member when the second elastic member deforms the second semi-rigid resilient member; and when the item is inserted into the sleeve chamber, the first and second sleeve chamber forces cause the deformable resilient member to engage the item, thereby holding the item in place within the sleeve chamber.

10. A system as recited in claim 9, in which the first and second sleeve chamber forces are in opposition.

11. A system as recited in claim 1, in which the inner sleeve assembly further comprises at least one opening panel assembly for selectively closing an opening in the inner sleeve assembly through which the item is inserted into the sleeve chamber.

12. A system as recited in claim 2, in which the outer bag assembly comprises a rear panel assembly, a primary panel assembly, an upper panel assembly, and an edge panel assembly that are joined together to define the primary chamber.

13. A system for a carrying an item, comprising:

an outer bag assembly defining a primary chamber; and an inner sleeve assembly comprising first and second side panel assemblies and a perimeter panel assembly joined to define a sleeve chamber; wherein the perimeter panel assembly comprises a deformable resilient member, a first elastic member, a second elastic member, a first semi-rigid resilient member arranged between the first elastic member and the deformable resilient member, and a second semi-rigid resilient member arranged between the second elastic member and the deformable resilient member, the first and second elastic member is arranged to apply first and second bias forces on the first and second semi-rigid resilient members, respectively to deform the first and second semi-rigid resilient members;

the first semi-rigid resilient member applies a first sleeve chamber force on the first resilient member when the first elastic member deforms the first semi-rigid resilient member;

the second semi-rigid resilient member applies a second sleeve chamber force on the first resilient member when the second elastic member deforms the second semi-rigid resilient member;

when the item is inserted into the sleeve chamber, the first and second sleeve chamber forces cause the first resilient member to engage the item, thereby holding the item in place within the sleeve chamber; and the inner sleeve assembly is inserted into the primary chamber.

14. A system as recited in claim 13, in which:

the outer bag assembly comprises a first connector portion; and the inner sleeve assembly comprises a second connector portion; wherein the first connector portion engages the second connector portion to support the inner sleeve assembly within the primary chamber.

15. A system as recited in claim 13, further comprising a plurality of connecting strap members, wherein:

the plurality of connecting strap members join the first side panel and the second side panel to the perimeter panel assembly; and the connecting strap members are deformable to allow a dimension of the sleeve chamber to be changed.

16. A system as recited in claim 13, in which the perimeter panel assembly further comprises at least one panel assembly defining first, second, third, and fourth pocket portions, wherein:

the first elastic member is connected to the first and second pockets;

the second elastic member is connected to the third and fourth pockets;

the first semi-rigid resilient member defines first and second ends that are received by the first and second pockets, respectively; and the second semi-rigid resilient member defines first and second ends that are received by the third and fourth pockets, respectively.

17. A system as recited in claim 1, in which the:

the first and second semi-rigid resilient members are formed by first and second elongate members, respectively; and when the first and second bias forces are applied to the first and second elongate members, the first and second elongate members bow such that middle portions of the first and second elongate members moves towards each other.

18. A system as recited in claim 1, in which the inner sleeve assembly further comprises at least one opening panel assembly for selectively closing an opening in the inner sleeve assembly through which the item is inserted into the sleeve chamber.

19. A method for a carrying an item, comprising the steps of:

providing first and second side panel assemblies and a perimeter panel assembly;

joining the first and second side panel assemblies and the perimeter panel assembly to form an inner sleeve assembly that defines a sleeve chamber;

providing a deformable resilient member, a semi-rigid resilient member, and an elastic member;

arranging the elastic member to deform the semi-rigid resilient member by applying a bias force on the semi-rigid resilient member to deform the semi-rigid resilient member;

arranging the semi-rigid resilient member to apply a sleeve chamber force on the deformable resilient member to deform the deformable resilient member; and inserting the item into the sleeve chamber such that the item deforms the deformable resilient member, the deformable resilient member deforms the semi-rigid resilient member, and the semi-rigid resilient member deforms the elastic member such that the item is snugly held in place within the sleeve chamber.

20. A method as recited in claim 19, further comprising the steps of:

providing an outer bag assembly defining a primary chamber; and disposing the inner sleeve assembly within the primary chamber.

* * * * *